US010262818B2

(12) United States Patent
Iwamoto

(10) Patent No.: US 10,262,818 B2
(45) Date of Patent: Apr. 16, 2019

(54) SWITCH

(71) Applicant: FUJITSU COMPONENT LIMITED, Tokyo (JP)

(72) Inventor: Daiei Iwamoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/543,644

(22) PCT Filed: Jan. 28, 2016

(86) PCT No.: PCT/JP2016/052466
§ 371 (c)(1),
(2) Date: Jul. 14, 2017

(87) PCT Pub. No.: WO2016/125675
PCT Pub. Date: Aug. 11, 2016

(65) Prior Publication Data

US 2017/0358410 A1 Dec. 14, 2017

(30) Foreign Application Priority Data

Feb. 6, 2015 (JP) ..... 2015-022620

(51) Int. Cl.

| | |
|---|---|
| ***H01H 33/18*** | (2006.01) |
| ***H01H 1/26*** | (2006.01) |
| ***H01H 9/44*** | (2006.01) |
| *H01H 9/40* | (2006.01) |

(52) U.S. Cl.
CPC ..... *H01H 33/182* (2013.01); *H01H 1/26* (2013.01); *H01H 9/443* (2013.01); *H01H 9/40* (2013.01)

(58) Field of Classification Search
CPC ..... H01H 9/443; H01H 33/182; H01H 9/36; H01H 1/20; H01H 33/596; H01H 9/346; H01H 50/546; H01H 9/46; H01H 33/08; H01H 33/20; H01H 33/666; H01H 31/003; H01H 33/38; H01H 33/6661; H01H 9/34
See application file for complete search history.

(56) References Cited

U.S. PATENT DOCUMENTS

| | | | | |
|---|---|---|---|---|
| 4,810,841 | A * | 3/1989 | Wolf | H01H 1/2066 218/22 |
| 2013/0037518 | A1 | 2/2013 | Iwamoto et al. | |
| 2013/0207750 | A1 * | 8/2013 | Daitoku | H01H 50/00 335/126 |

(Continued)

FOREIGN PATENT DOCUMENTS

| | | |
|---|---|---|
| JP | H10-154448 | 6/1998 |
| JP | 2004-355844 | 12/2004 |

(Continued)

*Primary Examiner* — Truc T Nguyen
(74) *Attorney, Agent, or Firm* — IPUSA, PLLC

(57) ABSTRACT

A switch includes a first switch (100) including a first fixed contact (111) and a first movable contact (121) and a second switch (200) including a second fixed contact (211) and a second movable contact (221). The first fixed contact (111) and the first movable contact (121) come into contact and the second fixed contact (211) and the second movable contact (221) come into contact to turn on the switch. A magnet (320) is installed between the first switch (100) and the second switch (200).

4 Claims, 12 Drawing Sheets

(56) References Cited

U.S. PATENT DOCUMENTS

| | | | | |
|---|---|---|---|---|
| 2014/0014622 | A1* | 1/2014 | Naka | H01H 9/443 218/4 |
| 2014/0175056 | A1* | 6/2014 | Gerving | H01H 9/346 218/23 |
| 2014/0319099 | A1* | 10/2014 | Baujan | H01H 1/2025 218/23 |
| 2015/0022291 | A1* | 1/2015 | Kashimura | H01H 9/443 335/131 |
| 2015/0022296 | A1* | 1/2015 | Takaya | H01H 50/04 335/201 |
| 2015/0130566 | A1* | 5/2015 | Kinsella | H01H 3/00 335/6 |
| 2016/0012990 | A1* | 1/2016 | Yang | H01H 33/18 218/22 |
| 2016/0329177 | A1* | 11/2016 | Ignatov | H01H 9/342 |

FOREIGN PATENT DOCUMENTS

| | | |
|---|---|---|
| JP | 2010-073352 | 4/2010 |
| JP | 2013-041690 | 2/2013 |
| JP | 2013-164900 | 8/2013 |

* cited by examiner

SWITCH

TECHNICAL FIELD

The present invention relates to switches.

BACKGROUND ART

When an electrical apparatus is supplied with electric power from a power supply, the power supply and the electrical apparatus are connected by a connector, and in this state, the on/off of a switch is controlled to supply the electric power.

In recent years, as a measure against global warming, supplying direct-current, high-voltage electric power has been studied in power transmission in local areas as well. Supplying direct-current, high-voltage electric power is limited in power loss in voltage conversion or power transmission and does not require an increase in cable thickness. In particular, such a supply of electric power is considered desirable for information apparatuses such as servers, which consume a large amount of electric power.

In the case of controlling such a supply of high-voltage electric power with a switch, an arc may be generated between terminals in the switch. When such an arc is generated, the terminals may be damaged by heat due to the arc. Therefore, a study has been made of methods of extinguishing a generated arc in a short time.

PRIOR ART DOCUMENT

Patent Document

[Patent Document 1] Japanese Laid-open Patent Publication No. 2013-41690

SUMMARY OF THE INVENTION

Problems to be Solved by the Invention

The method disclosed in Patent Document 1 is a structure using permanent magnets for extinguishing a generated arc, where one permanent magnet is installed for each contact pair formed of a fixed contact and a movable contact. In the case of controlling a supply of high-voltage electric power, however, a switch including multiple pairs of contacts, for example, a switch including two pairs of contacts referred to as a double-pole switch, is used. In the case of installing one permanent magnet for each pair of contacts in such a double-pole switch, permanent magnets commensurate in number with pairs of contacts, namely, two permanent magnets, are required, thus causing problems such as increases in the cost, size, and weight of the switch.

Therefore, there is a demand for a switch including multiple pairs of contacts that is capable of extinguishing an arc at low cost without an increase in size.

Means for Solving the Problems

According to an aspect of the present invention, in a switch that includes a first switch including a first fixed contact and a first movable contact and a second switch including a second fixed contact and a second movable contact, wherein the first fixed contact and the first movable contact come into contact and the second fixed contact and the second movable contact come into contact to turn on the switch, a magnet is installed between the first switch and the second switch.

Effects of the Invention

According to an embodiment of the present invention, a switch including multiple pairs of contacts can extinguish an arc at low cost without an increase in size.

MODES FOR CARRYING OUT THE INVENTION

Figure 1:
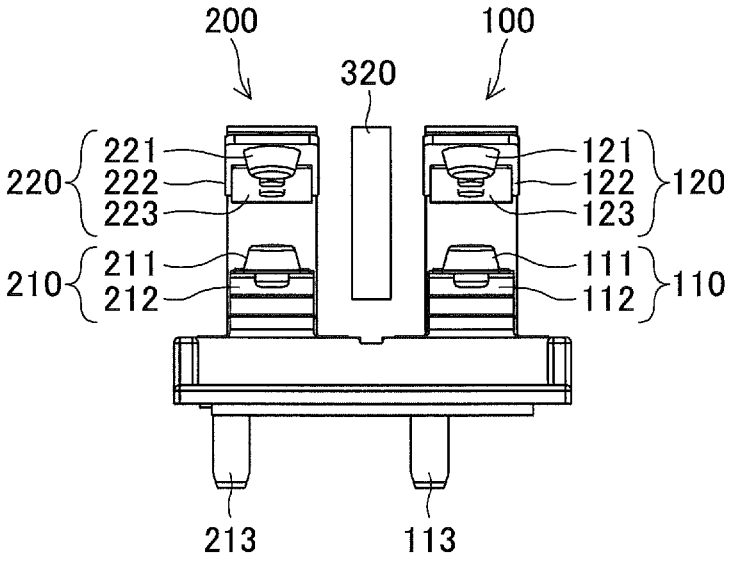
FIG. 1 is a front view of a switch according to a first embodiment.

Embodiments of the present invention are described below. The same members or the like are given the same reference numeral, and a description thereof is omitted.

Switches described in the embodiments support high voltage. According to the embodiments, however, high voltage does not mean "DC 750V or higher" defined in the Electrical Equipment Technical Standards or "DC 1500 V or higher" internationally defined by the International Electrotechnical Commission (IEC), but means voltages exceeding the safe low voltage (below DC 60 V), namely, 60 V or higher.

First Embodiment

Figure 2:
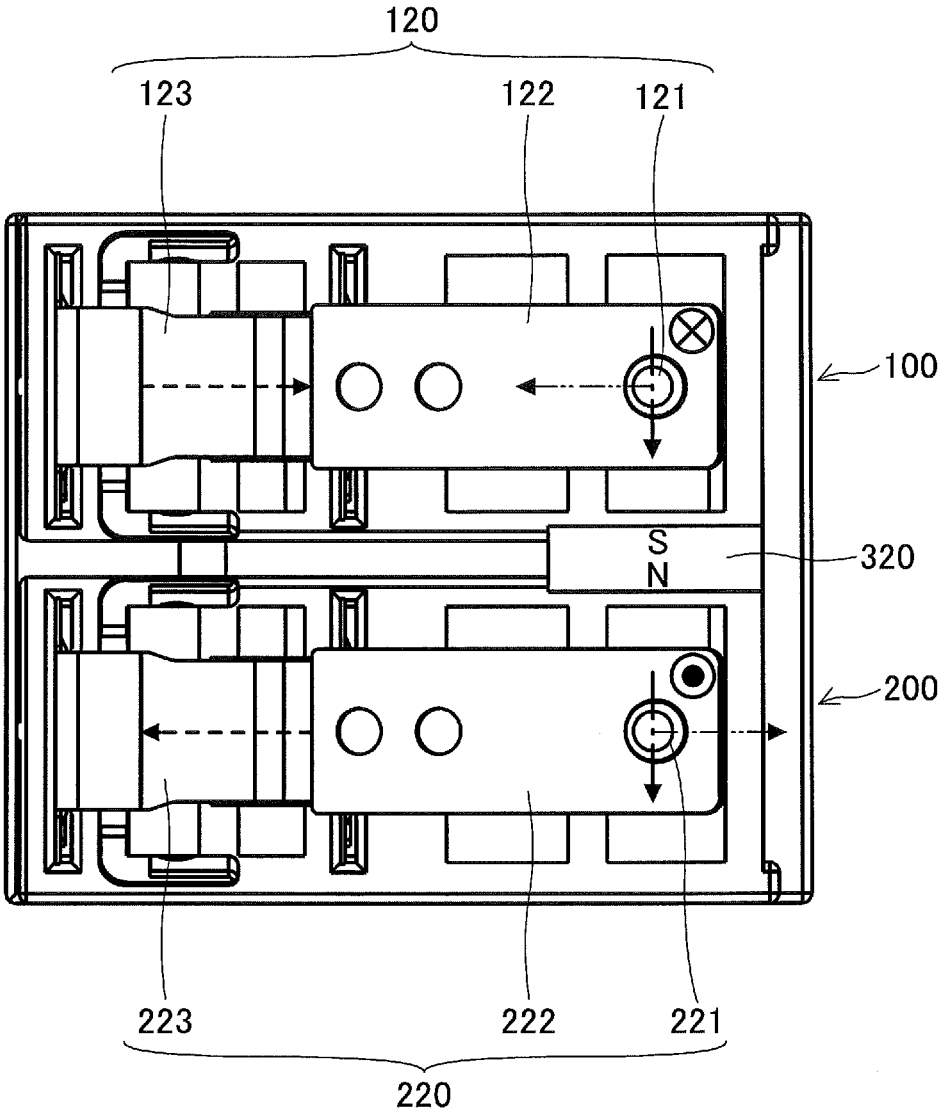
FIG. 2 is a plan view of the switch according to the first embodiment.
Figure 3:
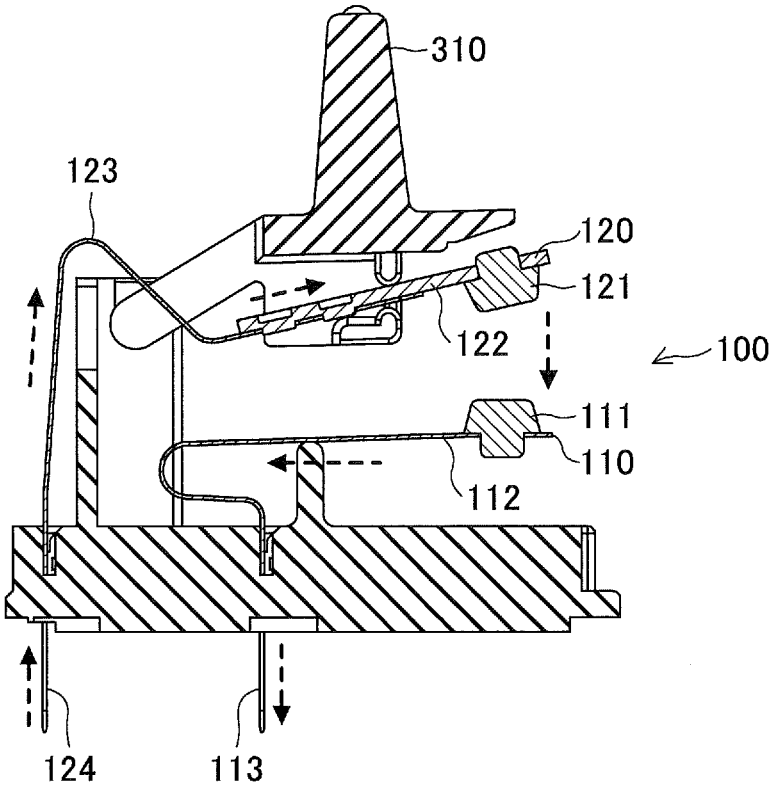
FIG. 3 is a cross-sectional view of the switch according to the first embodiment.
Figure 4:
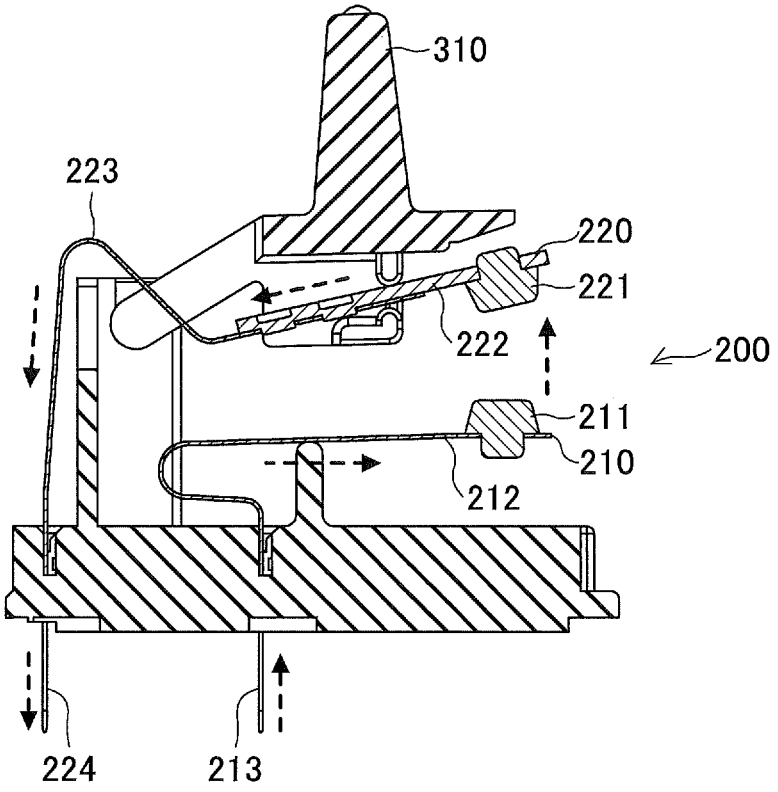
FIG. 4 is a cross-sectional view of the switch according to the first embodiment.

A switch according to a first embodiment is described based on FIGS. 1 through 5. FIG. 1 is a front view and FIG. 2 is a plan view of a main part of the switch according to this embodiment. FIG. 3 is a cross-sectional view at a first switch 100. FIG. 4 is a cross-sectional view at a second switch 200.

The switch according to this embodiment, which is referred to as a double-pole switch, includes the first switch 100 and the second switch 200 as depicted in FIGS. 1 through 4. The first switch 100 includes a first fixed part 110 and a first movable part 120, and the second switch 200 includes a second fixed part 210 and a second movable part 220.

In the switch according to this embodiment, the first fixed part 110 and the first movable part 120 contact and the second fixed part 210 and the second movable part 220 contact to turn on the switch to supply electric power to an electronic apparatus or the like. When one of the first switch 100 and the second switch 200 is open, the switch is turned off to supply no electric power to an electronic apparatus or the like.

The first fixed part 110 includes a first fixed contact 111 and a first fixed spring 112, and a first fixed part external terminal 113 is connected to the first fixed spring 112. The second fixed part 210 includes a second fixed contact 211 and a second fixed spring 212, and a second fixed part external terminal 213 is connected to the second fixed spring 212. The first movable part 120 includes a first movable contact 121, a first movable plate 122, and a first movable spring 123, and a first movable part external terminal 124 is connected to the first movable spring 123. The second movable part 220 includes a second movable contact 221, a second movable plate 222, and a second movable spring 223, and a second movable part external terminal 224 is connected to the second movable spring 223.

The first movable plate 122 and the second movable plate 222 are both connected to a card 310. Therefore, by depressing the card 310, it is possible to move the first movable contact 121 and the second movable contact 221 downward. As a result, it is possible to bring the first movable contact 121 into contact with the first fixed contact 111 and to bring the second movable contact 221 into contact with the second fixed contact 211. Thus, the switch according to this embodiment turns on.

In the switch according to this embodiment, a permanent magnet 320 for extinguishing an arc is installed between the first switch 100 and the second switch 200. To be more specific, the permanent magnet 320 is installed between where the first fixed contact 111 and the first movable contact 121 are placed and where the second fixed contact 211 and the second movable contact 221 are placed. As a result, it is possible to produce a magnetic field in a region between the contacts of the first switch 100 and in a region between the contacts of the second switch 200. By thus causing a magnetic field to be produced in a region between contacts, it is possible to blow an arc and efficiently extinguish the arc when the arc is generated between the contacts.

Figure 5:
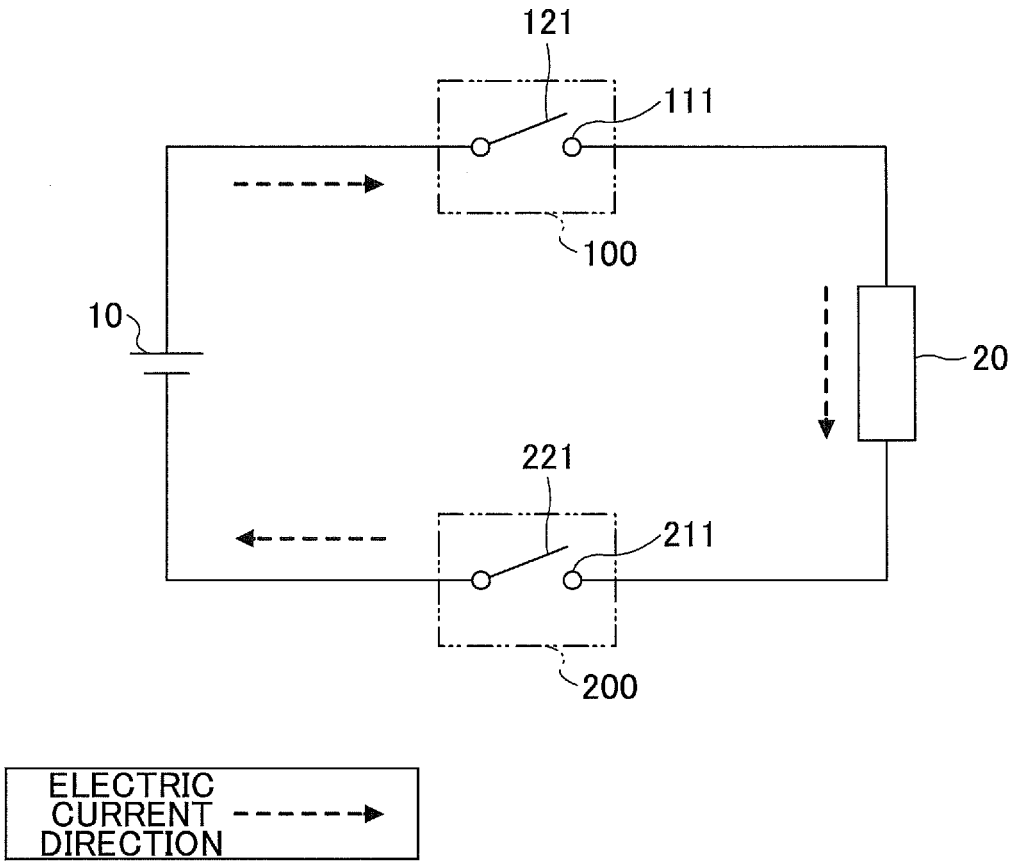
FIG. 5 is a diagram of a circuit in which the switch according to the first embodiment is installed.

The switch according to this embodiment is connected to a direct-current power supply 10 and an electronic apparatus 20 serving as a load as depicted in FIG. 5. The positive terminal of the direct-current power supply 10 is connected to the first movable contact 121, and the first fixed contact 111 is connected to the electronic apparatus 20. The negative terminal of the direct-current power supply 10 is connected to the second movable contact 221, and the second fixed contact 211 is connected to the electronic apparatus 20.

As a result of connecting the switch according to this embodiment to the direct-current power supply 10 and the electronic apparatus 20 as depicted in FIG. 5, when the switch is turned on, an electric current flows in the direction of dashed arrows in FIGS. 2, 3 and 4. Specifically, an electric current flows from the first movable contact 121 to the first fixed contact 111 in the first switch 100, and flows from the second fixed contact 211 to the second movable contact 221 in the second switch 200. As depicted in FIG. 2, when the permanent magnet 320 is installed with the S pole on the first switch 100 side and the N pole on the second switch 200 side, the magnetic field of the permanent magnet 320 is produced in the direction indicated by one-dot chain arrows in FIG. 2. Accordingly, an arc can be blown in directions indicated by two-dot chain arrow, namely, in a direction toward the first movable spring 123 and the first fixed spring 112 in a view from the contacts in the first switch 100 and in a direction away from the second movable spring 223 and the second fixed spring 212 in a view from the contacts in the second switch 200.

According to this embodiment, in a double-pole switch including the first switch 100 and the second switch 200 as well, it is possible to blow an arc generated between either contacts with the single permanent magnet 320. Accordingly, it is possible to obtain a small, light-weight switch capable of extinguishing an arc at low cost.

Figure 6:
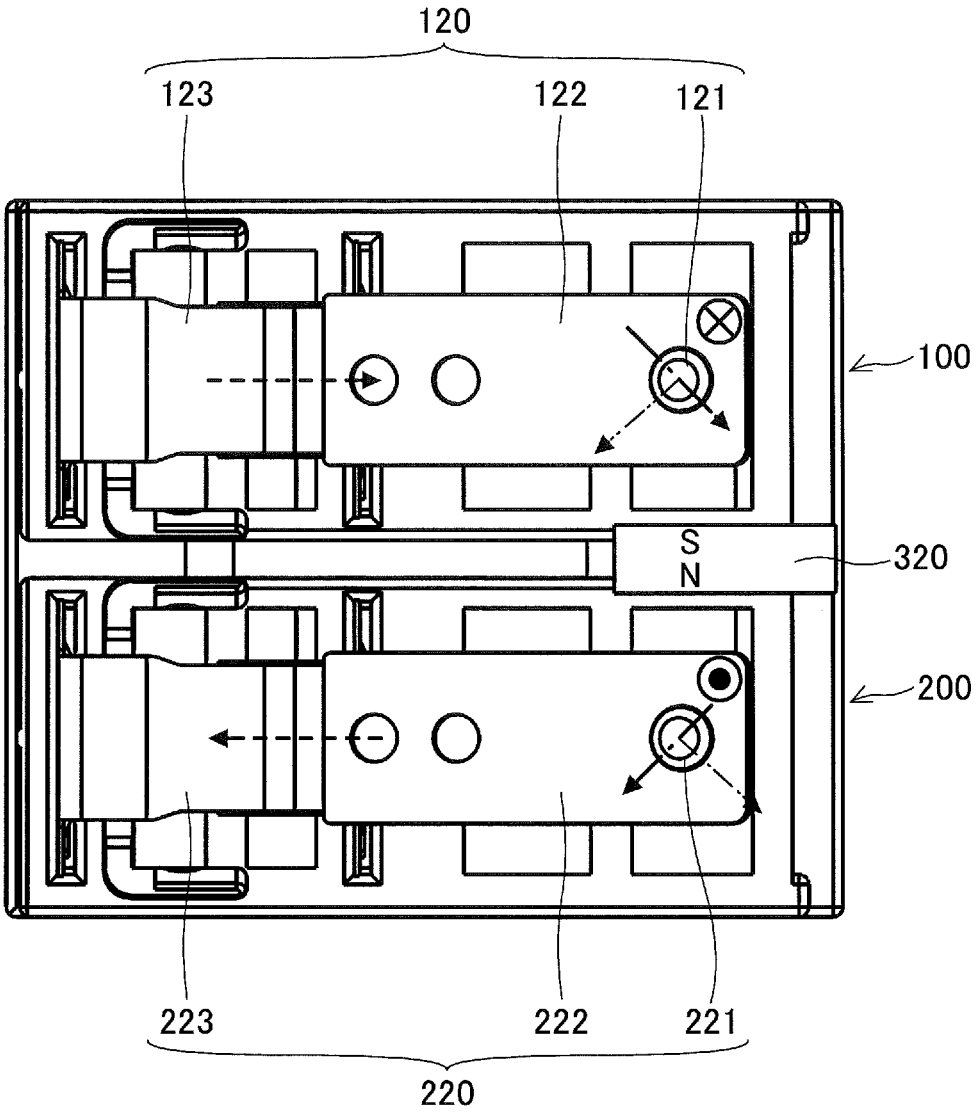
FIG. 6 is a plan view of another switch according to the first embodiment.

In the switch according to this embodiment, as depicted in FIG. 6, the permanent magnet 320 may be installed at a position offset outward (rightward in FIG. 6) from an intermediate position between the first fixed contact 111/the first movable contact 121 and the second fixed contact 211/the second movable contact 221. In this case, the direction of the magnetic field acting on each contact position is diagonal relative to the extension direction of the movable spring/the fixed spring as indicated by a two-dot chain arrow in FIG. 6. As a result, it is possible to blow an arc generated in the first switch 100 in a direction not parallel to a direction in which an electric current flows in the first fixed spring 112 and the first movable spring 123. Thus, the arc is easily extinguishable. It is also possible to blow an arc generated in the second switch 200 in a direction not parallel to a direction along the second fixed spring 212 and the second movable spring 223. In FIG. 6, a direction in which an electric current flows is indicated by dashed arrows, the direction of the magnetic field generated by the permanent magnet 320 is indicated by one-dot chain arrows, and directions in which arcs are blown are indicated by two-dot chain arrows.

In the case of FIG. 2, an arc generated in the first switch 100 is blown toward the base of the first movable spring 123. Therefore, the arc cannot be extended beyond the base of the first movable spring 123, and there is a possibility that the arc cannot be sufficiently extinguished. In contrast, by blowing an arc as in FIG. 6, it is possible to sufficiently extend an arc generated between contacts. Thus, it is possible to extinguish an arc more effectively.

The switch according to this embodiment may be used independently as a switch, and may also be used as a connector with a switch in which the switch is incorporated into a connector.

Second Embodiment

Figure 7:
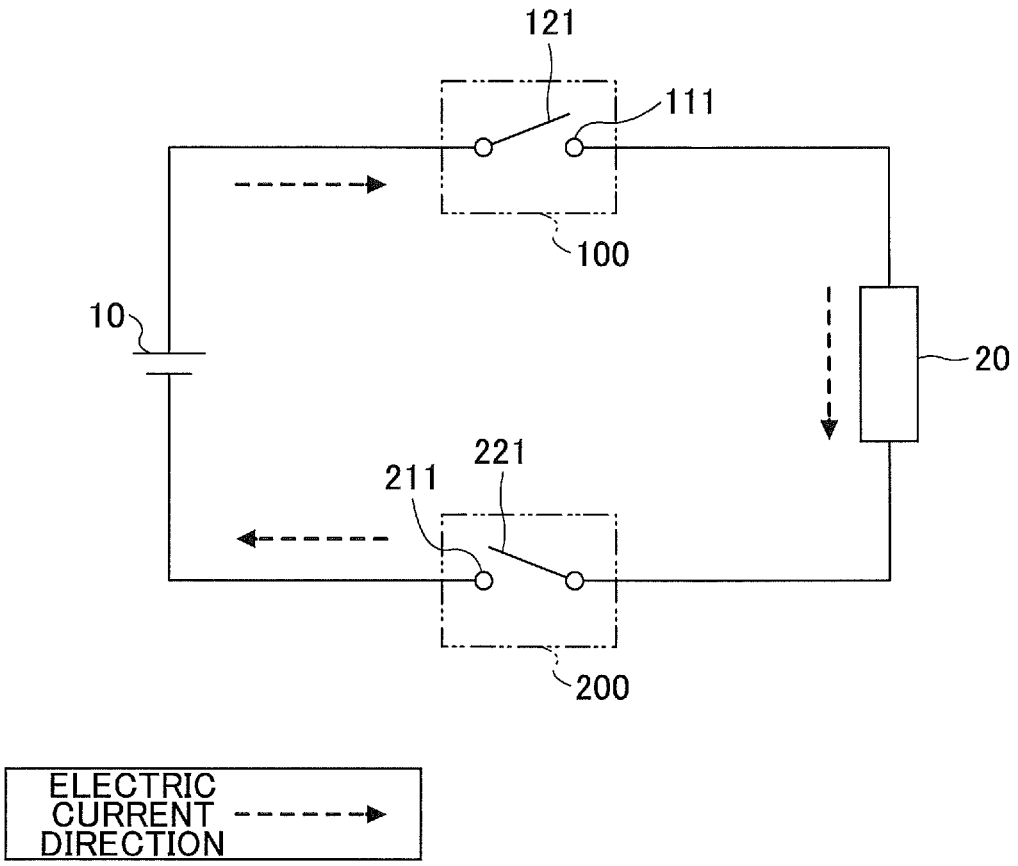
FIG. 7 is a diagram of a circuit in which a switch according to a second embodiment is installed.
Figure 8:
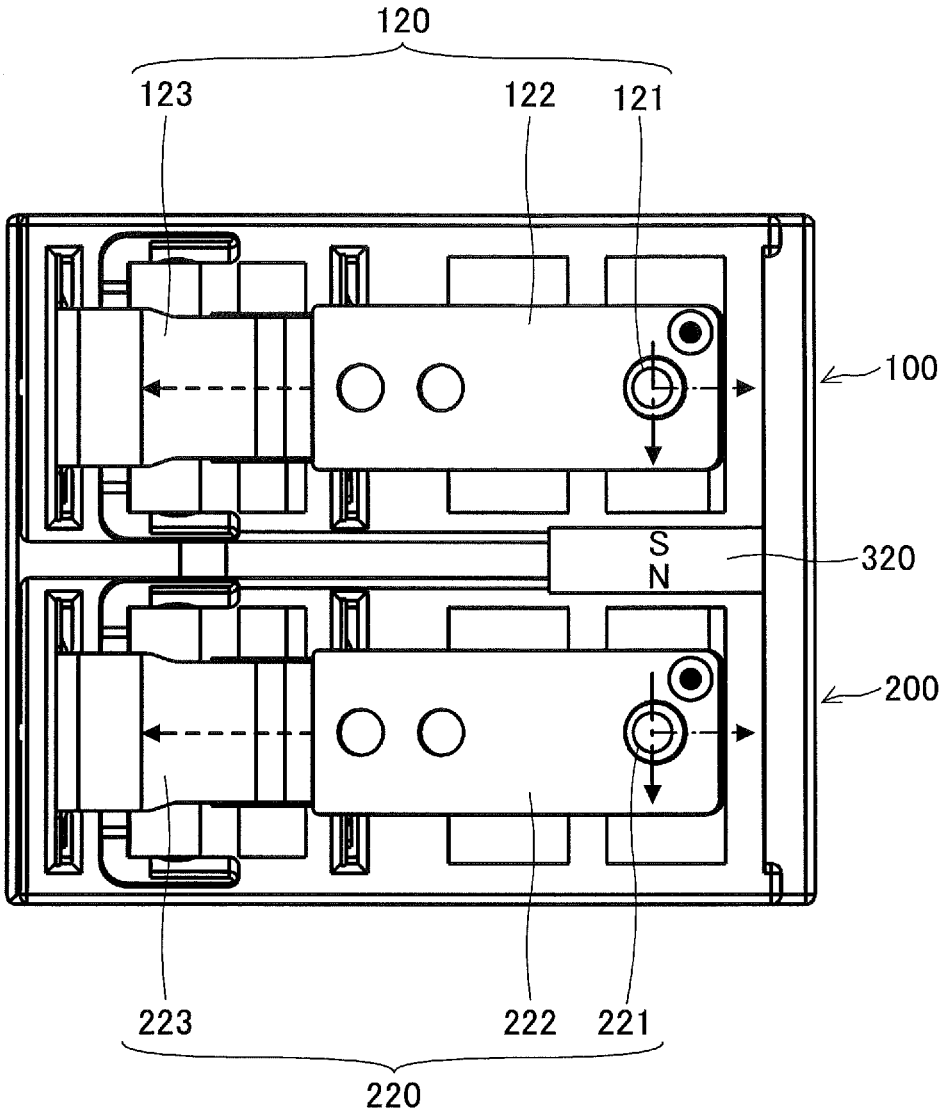
FIG. 8 is a plan view of the switch according to the second embodiment.
Figure 9:
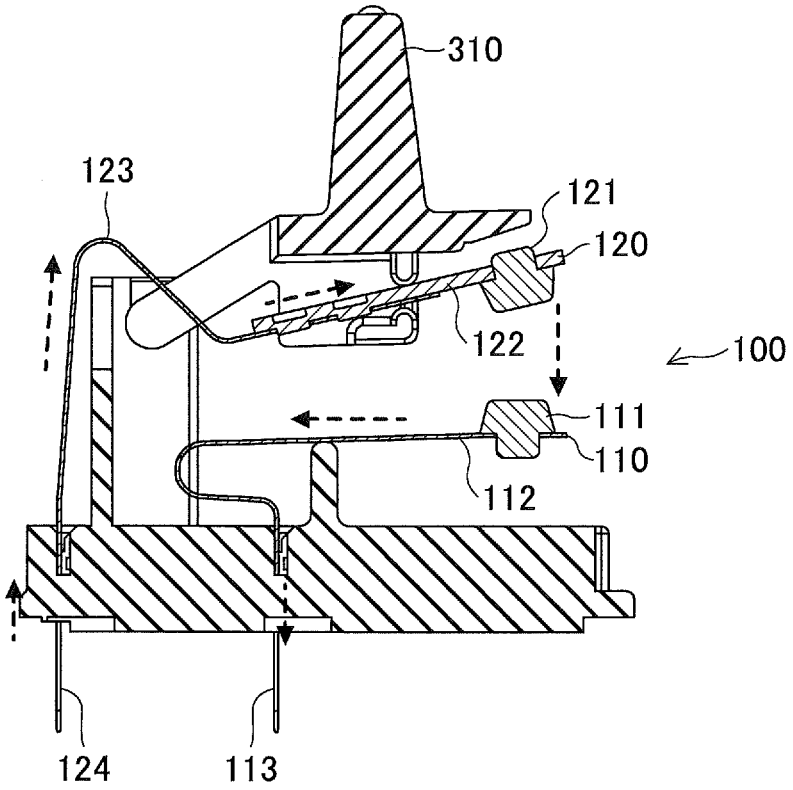
FIG. 9 is a cross-sectional view of the switch according to the second embodiment.
Figure 10:
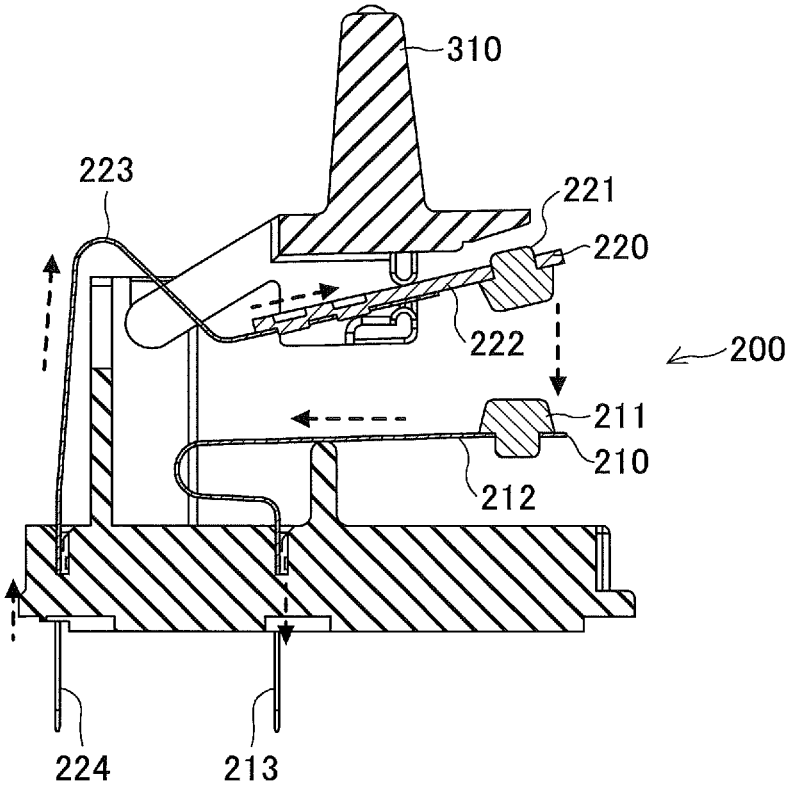
FIG. 10 is a cross-sectional view of the switch according to the second embodiment.

Next, a second embodiment is described. In a switch according to this embodiment, an electric current flows from a movable contact to a fixed contact in both the first switch 100 and the second switch 200. The switch according to this embodiment is described based on FIGS. 7 through 10. FIG. 7 is a circuit diagram illustrating a connection state of the switch according to this embodiment. FIG. 8 is a plan view of a main part of the switch according to this embodiment. FIG. 9 is a cross-sectional view at the first switch 100. FIG. 10 is a cross-sectional view at the second switch 200.

The switch according to this embodiment is connected to the direct-current power supply 10 and the electronic apparatus 20 as depicted in FIG. 7. The positive terminal of the direct-current power supply 10 is connected to the first movable contact 121, and the first fixed contact 111 is connected to the positive terminal of the electronic apparatus 20. The negative terminal of the direct-current power supply 10 is connected to the second fixed contact 211, and the second movable contact 221 is connected to the negative terminal of the electronic apparatus 20.

As a result of connecting the switch according to this embodiment to the direct-current power supply 10 and the electronic apparatus 20 as depicted in FIG. 7, when the switch is turned on, an electric current flows in the direction indicated by dashed arrows in FIGS. 8, 9 and 10. Specifically, an electric current flows from the first movable contact 121 to the first fixed contact 111 in the first switch 100, and flows from the second movable contact 221 to the second fixed contact 211 in the second switch 200 as well. As depicted in FIG. 8, when the permanent magnet 320 is installed with the S pole on the first switch 100 side and the N pole on the second switch 200 side, the magnetic field produced by the permanent magnet 320 is produced in the direction indicated by one-dot chain arrows in FIG. 8.

Accordingly, an arc generated between the contacts of the first switch 100 can be blown in a direction indicated by a two-dot chain arrow, namely, in a direction away from the first movable spring 123 and the first fixed spring 112 in a view from the contacts. In the second switch 200 as well, an arc can be blown in a direction away from the second movable spring 223 and the second fixed spring 212 in a view from the contacts. In other words, it is possible to blow an arc in a direction away from the first fixed part 110 and the first movable part 120 in the first switch 100, and it is possible to blow an arc in a direction away from the second fixed part 210 and the second movable part 220 in the second switch 200 as well.

The above description is given of the case where an electric current flows from the first movable contact 121 to the first fixed contact 111 in the first switch 100, and flows from the second movable contact 221 to the second fixed contact 211 in the second switch 200 as well. Alternatively, it is also possible to connect the switch to a power supply and a load so that an electric current flows from the fixed contact to the movable contact in both the first switch 100 and the second switch 200 and to install the permanent magnet 320 in the reverse orientation, namely, with the N pole on the first switch 100 side and the S pole on the second switch 200 side.

In other respects than those described above, the arrangement is the same as in the first embodiment.

Third Embodiment

Figure 11:
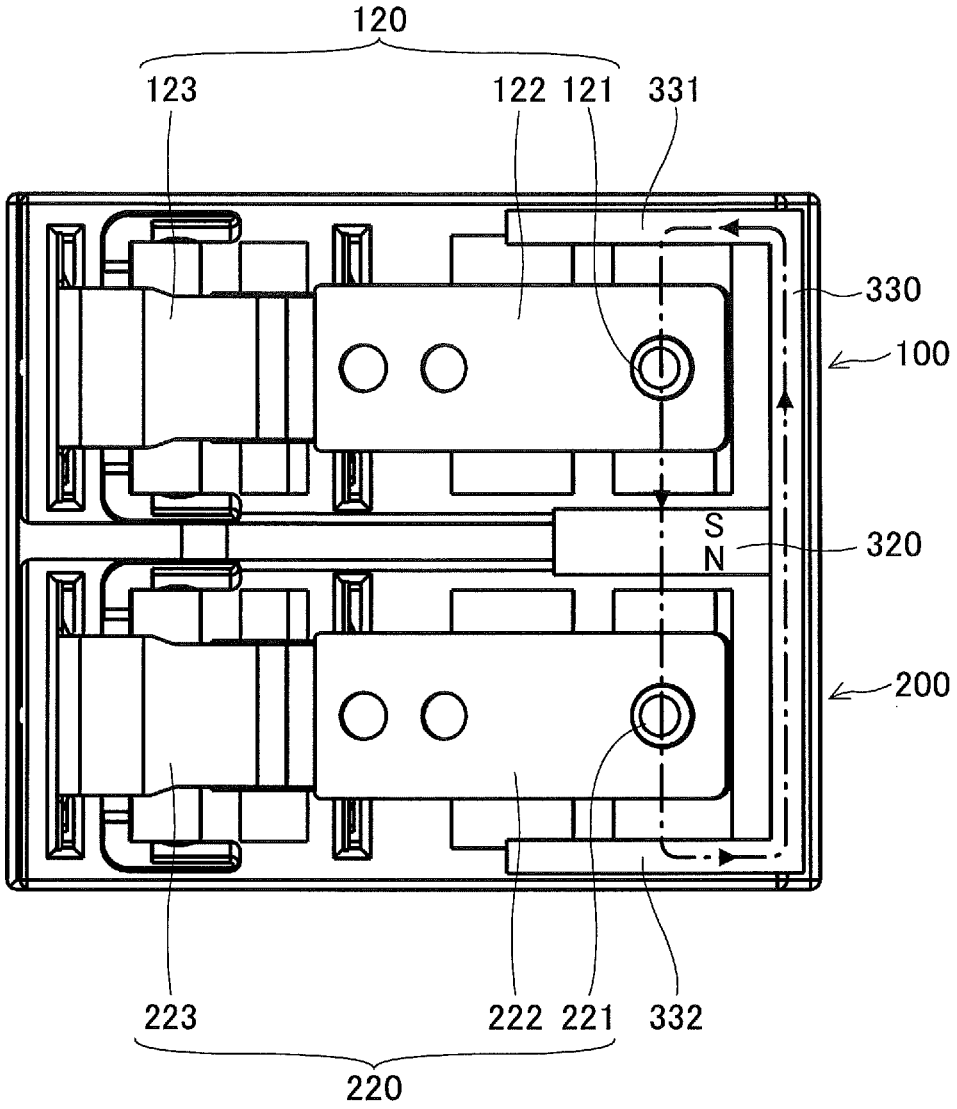
FIG. 11 is a plan view of a switch according to a third embodiment.
Figure 12:
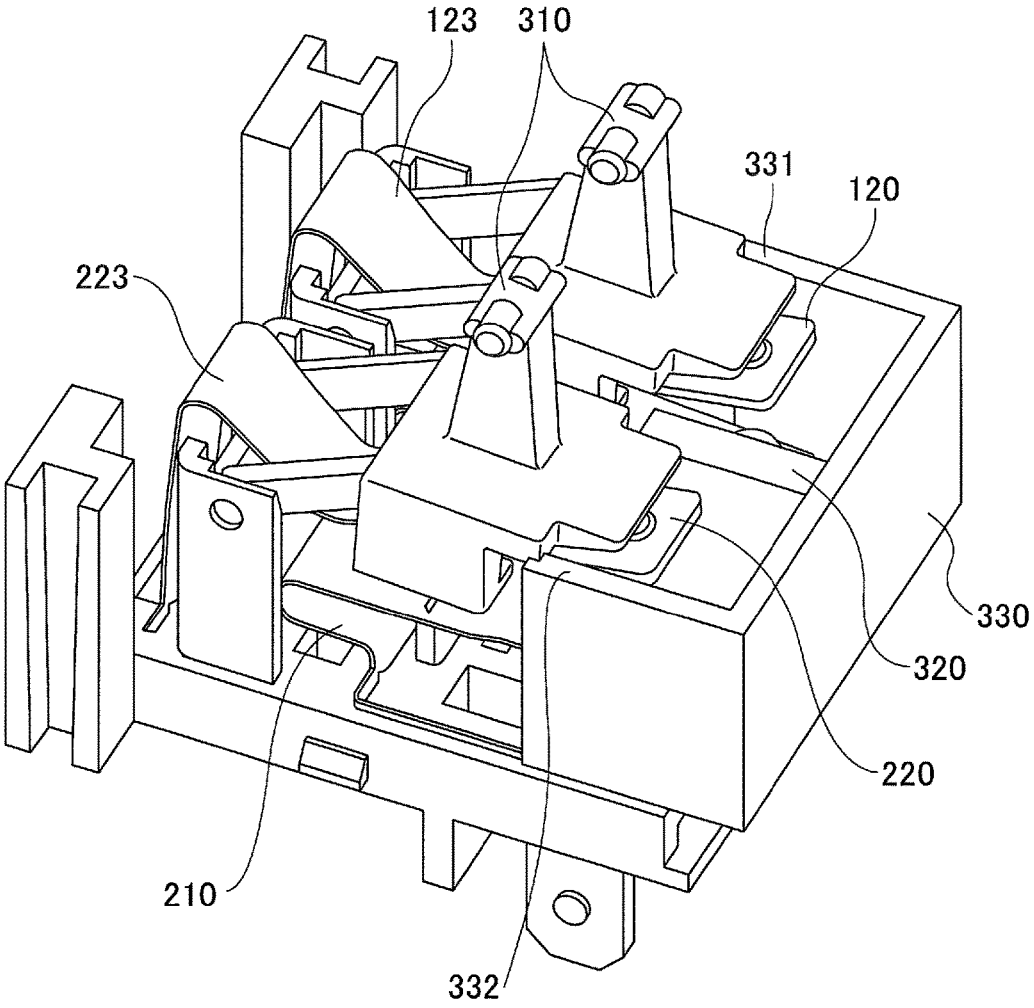
FIG. 12 is a perspective view of the switch according to the third embodiment.

Next, a third embodiment is described based on FIGS. 11 and 12. A switch according to this embodiment has a structure where a yoke 330 for concentrating a magnetic field on a region between fixed contacts and movable contacts is provided. That is, the yoke 330 for concentrating the magnetic field generated by the permanent magnet 320 on the inter-contact region between the first fixed contact 111 and the first movable contact 121 and the inter-contact region between the second fixed contact 211 and the second movable contact 221 is provided.

The yoke 330 is formed in a squared U shape. The permanent magnet 320 is installed near the internal center of the yoke 330. The first fixed contact 111 and the first movable contact 121, and the second fixed contact 211 and the second movable contact 221 are installed to be positioned within the squared U-shaped portion of the yoke 330. Accordingly, the first fixed contact 111 and the first movable contact 121 are placed between one end 331 of the yoke 330 and the permanent magnet 320, and the second fixed contact 211 and the second movable contact 221 are placed between another end 332 of the yoke 330 and the permanent magnet 320.

The yoke 330 is formed of a material containing a magnetic material such as iron, cobalt, or nickel. The permanent magnet 320 and the yoke 330 are in contact to reduce the leakage of a magnetic flux, and a magnetic flux produced by the permanent magnet 320 passes in the yoke 330. That is, a magnetic flux from the permanent magnet 320 passes in the yoke 330 and passes between the first fixed contact 111 and the first movable contact 121 and between the second fixed contact 211 and the second movable contact 221 as indicated by a one-dot chain line in FIG. 11.

According to this embodiment, it is possible to concentrate a magnetic field produced by the permanent magnet 320 on the inter-contact region of the first switch 100 sandwiched between the one end 331 of the yoke 330 and the permanent magnet 320 and on the inter-contact region of the second switch 200. As a result, it is possible to strengthen a magnetic field in the region between the first fixed contact 111 and the first movable contact 121 and the region between the second fixed contact 211 and the second movable contact 221, and when an arc is generated between contacts, it is possible to efficiently extinguish the arc in a short time.

The contents other than those described above are the same as in the first embodiment.

Embodiments of the present invention are described above, but the above description does not limit the subject matter of the present invention.

The present international application is based upon and claims priority to Japanese Patent Application No. 2015-022620, filed on Feb. 6, 2015, the entire contents of which are incorporated herein by reference.

DESCRIPTION OF THE REFERENCE NUMERALS

10 power supply
20 electronic apparatus
100 first switch
110 first fixed part
111 first fixed contact
112 first fixed spring
113 first fixed part external terminal
120 first movable part
121 first movable contact
122 first movable plate
123 first movable spring
124 first movable part external terminal
200 second switch
210 second fixed part
211 second fixed contact
212 second fixed spring
213 second fixed part external terminal
220 second movable part
221 second movable contact
222 second movable plate
223 second movable spring
224 second movable part external terminal
310 card
320 permanent magnet
330 yoke
331 one end
332 another end

The invention claimed is:

1. A switch comprising:
a first switch including
a first fixed contact; and
a first movable contact on a first movable plate;
a second switch including
a second fixed contact; and
a second movable contact on a second movable plate;
a card connected to the first movable plate and the second movable plate, the card being configured to be depressed to move the first movable contact and the second movable contact toward the first fixed contact and the second fixed contact, respectively, so that the first fixed contact and the first movable contact come into contact and the second fixed contact and the second movable contact come into contact to turn on the switch; and a magnet installed between the first switch and the second switch, wherein a first region between the first fixed contact and the first movable contact and a second region between the second fixed contact and the second movable contact are opposite each other across the magnet.

2. The switch as claimed in claim 1, comprising:

a yoke formed in a squared U shape, wherein the yoke and the magnet are in contact, the first switch is positioned between one end of the yoke and the magnet, and the second switch is positioned between another end of the yoke and the magnet.

3. The switch as claimed in claim 1, wherein the switch is a double-pole switch.

4. A switch comprising:

a first switch including a first fixed contact fixed to a first fixed spring; and a first movable contact fixed to a first movable spring, and configured to contact the first fixed contact;

a second switch including a second fixed contact fixed to a second fixed spring; and a second movable contact fixed to a second movable spring, and configured to contact the second fixed contact; and a magnet installed between the first switch and the second switch, the magnet being so positioned as to blow a first arc generated in the first switch in a first direction diagonal to a first extension direction in which the first fixed spring extends and to blow a second arc generated in the second switch in a second direction diagonal to a second extension direction in which the second fixed spring extends.

* * * * *